US008981656B2

(12) United States Patent
Mieskoski

(10) Patent No.: US 8,981,656 B2
(45) Date of Patent: Mar. 17, 2015

(54) RELAMPING CIRCUIT FOR FLUORESCENT BALLASTS

(75) Inventor: James Dominic Mieskoski, East Cleveland, OH (US)

(73) Assignee: General Electric Company, Schenectady, NY (US)

( * ) Notice: Subject to any disclaimer, the term of this patent is extended or adjusted under 35 U.S.C. 154(b) by 45 days.

(21) Appl. No.: 13/438,034

(22) Filed: Apr. 3, 2012

(65) Prior Publication Data

US 2013/0257307 A1 Oct. 3, 2013

(51) Int. Cl.

| | |
|---|---|
| ***H05B 37/02*** | (2006.01) |
| ***H05B 41/298*** | (2006.01) |
| ***H05B 37/03*** | (2006.01) |
| ***H05B 33/08*** | (2006.01) |

(52) U.S. Cl.

CPC ..... *H05B 41/2985* (2013.01); *H05B 37/03* (2013.01); *H05B 33/0803* (2013.01)

USPC ..... 315/224; 315/158; 315/312

(58) Field of Classification Search

None

See application file for complete search history.

(56) References Cited

U.S. PATENT DOCUMENTS

| | | | | |
|---|---|---|---|---|
| 4,256,993 | A * | 3/1981 | Morton | 315/106 |
| 5,883,473 | A | 3/1999 | Li et al. | |
| 6,501,225 | B1 | 12/2002 | Konopka | |
| 7,183,714 | B1 * | 2/2007 | Choudhury | 315/97 |
| 7,327,101 | B1 * | 2/2008 | Chen et al. | 315/307 |
| 8,004,198 | B2 * | 8/2011 | Bakre et al. | 315/86 |
| 8,084,949 | B2 * | 12/2011 | Nerone | 315/158 |
| 8,344,628 | B2 * | 1/2013 | Kishimoto | 315/119 |
| 8,384,310 | B2 * | 2/2013 | Nerone | 315/307 |
| 2005/0184685 | A1 * | 8/2005 | Sekine et al. | 315/312 |
| 2010/0327763 | A1 | 12/2010 | Yao | |
| 2011/0006699 | A1 | 1/2011 | Nerone | |
| 2013/0264952 | A1 * | 10/2013 | Yao et al. | 315/178 |

FOREIGN PATENT DOCUMENTS

| | | | |
|---|---|---|---|
| DE | 102005018761 | A1 | 10/2006 |
| WO | 2006111263 | A1 | 10/2006 |
| WO | 2011007283 | A2 | 1/2011 |

OTHER PUBLICATIONS

Search Report and Written Opinion from corresponding PCT Application No. PCT/US2013/028590, dated Jul. 16, 2013.

* cited by examiner

*Primary Examiner* — Jason M Crawford
*Assistant Examiner* — Nelson Correa
(74) *Attorney, Agent, or Firm* — GE Global Patent Operation; Peter T. DiMauro

(57) ABSTRACT

A system and method of controlling a lighting system is provided. Lamp insertion detectors are coupled to a ballast and detect when relamping occurs. The outputs of the lamp insertion detectors are coupled together to provide a single input of a timing circuit. The timing circuit generates an output having a predetermined duration. This timing circuit output is received by a ballast driver circuit, which causes the ballast to provide a high voltage to a lamp socket for a predetermined duration of the timing circuit output to ignite the new lamp.

18 Claims, 6 Drawing Sheets

RELAMPING CIRCUIT FOR FLUORESCENT BALLASTS

FIELD OF THE INVENTION

The present disclosure relates to a lighting system and more particularly to a system and method for detecting relamping and igniting the new lamp.

BACKGROUND OF THE INVENTION

Fluorescent lamps include filaments or electrodes at each end of a glass tube, an ionizable gas, and a phosphor coating on the inside of the glass tube. When current is supplied to the filaments a voltage is induced ionizing the gas and forming an electric arc between the filaments. The electric arc generates a flow of electric current through the ionized gas causing electrons to be excited and producing light emissions. Typically, the filaments are coated with an emission mix to facilitate electron emission. The use of a ballast in a fluorescent lamp system extends the life of the lamps by preheating the filaments to mitigate the depletion of the emission mix coating.

A lamp reaches an end-of-life stage when the emission mix becomes depleted on a filament causing the lamp to draw more voltage to continue normal operation. This higher voltage results in an increase in lamp temperature which may damage the lamp or the lamp socket. A lamp at the end-of-life stage, can be replaced or, as it is sometimes technically called, relamped.

During relamping, the system can detect that the new lamp has been inserted. Conventionally, such detection has required that each lamp have a corresponding relamping detector and timing circuit. Including a separate relamping detector and timing circuit for each lamp creates extensive circuitry. Such circuitry requires a substantial footprint on a printed circuit board, a relatively large ballast, and adds to the complexity and cost of the circuitry.

In another conventional approach, all outputs of the relamping detectors are coupled to separate terminals of a timing circuit, which determines when relamping occurs. However, this arrangement also increases the complexity, size, and cost of the timing circuit.

BRIEF DESCRIPTION OF THE INVENTION

This disclosure is directed to an improved system and method for controlling a light system after relamping. Embodiments of the system and method offer one or more differences and/or advantages over prior systems and methods. For example, it has been discovered that a lighting system does not need an individual timing circuit for each and every lamp, as conventionally taught. Instead, and in contrast to prior systems and methods, embodiments of the invention combine a plurality of lamp insertion detector outputs, one for each lamp, into a single input of a common timing circuit, and arrange the timing circuit to output a signal of predetermined duration to a ballast driver circuit. By eliminating multiple timing circuits, one for each lamp, that prior systems require, embodiments of the invention are characterized by more compact circuitry that uses less space on a printed circuit board. Upon receipt of the timing circuit output, the ballast driver circuit operates to provide a high voltage for the predetermined duration of the timing circuit output. This high voltage is sufficient to start the new lamp.

One exemplary aspect of the present disclosure is directed to a lighting system. The lighting system includes a ballast having a ballast driver circuit and a timing circuit. The lighting system further includes a plurality of lamp sockets coupled to the ballast driver circuit and a plurality of lamp insertion detectors. Each lamp insertion detector is associated with at least one of the plurality of lamp sockets. Each of the lamp insertions detectors is configured to provide an output associated with lamp insertion into one of the plurality of lamp sockets. The outputs of the plurality of lamp insertion detectors are combined to form an input of the timing circuit. The timing circuit is configured to provide a control output to the ballast driver circuit based at least in part on the combined outputs received at the input of the timing circuit.

Another exemplary aspect of the present disclosure is directed to a method for controlling a lighting system. The method includes providing an output from each of a plurality of lamp insertion detectors. Each lamp insertion detector is associated with at least one of the plurality of lamp sockets. Each output is associated with lamp insertion into one of the plurality of lamp sockets. The method further includes combining the output from each of the plurality of lamp insertion detectors at an input received at a timing circuit and providing a control output from the timing circuit to a ballast driver circuit based at least in part on the combined outputs received at the input of the timing circuit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

Reference is now made briefly to the accompanying drawings in which.

DETAILED DESCRIPTION OF THE INVENTION

Figure 1:
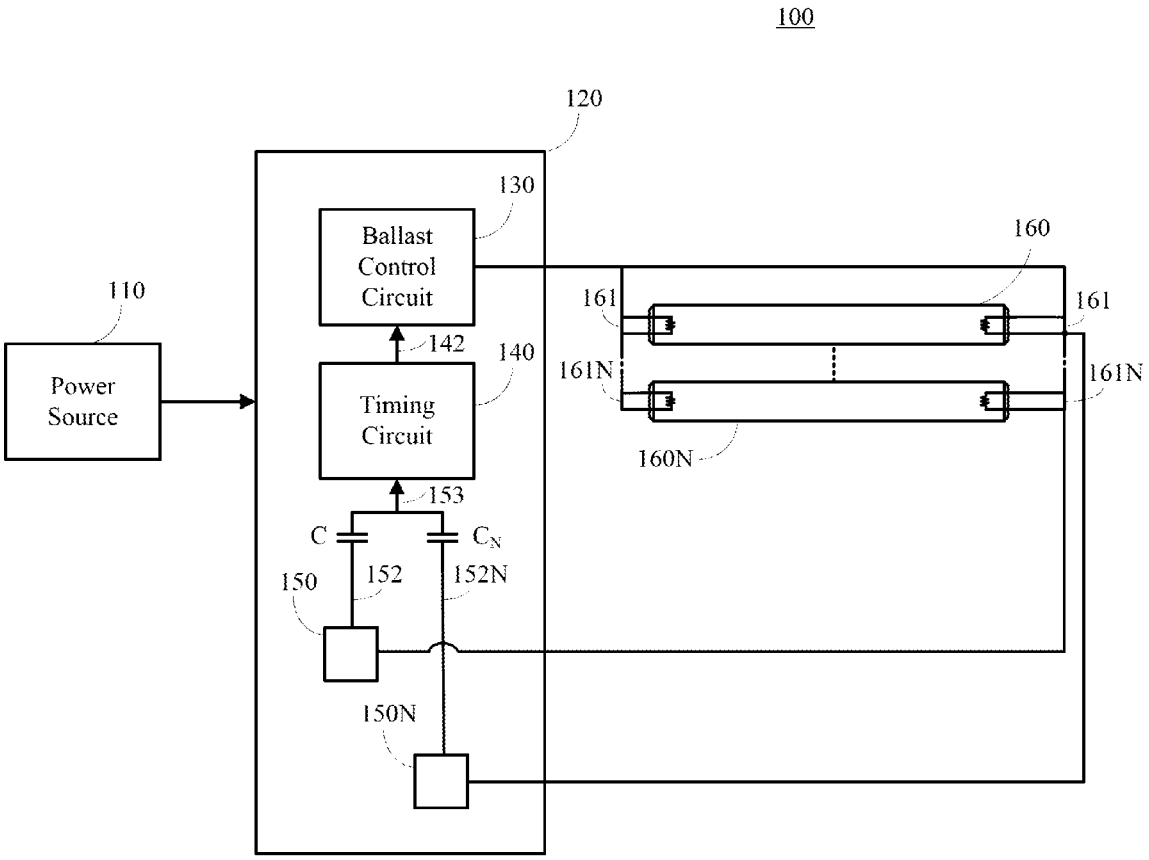
FIG. 1 provides a block diagram of an exemplary lighting system according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the subject matter of the present disclosure relates to a system and method of controlling a lighting system having a ballast including a ballast driver circuit. Lamp insertion detectors are included with the lighting system to detect when lamp insertion occurs. The outputs of the lamp insertion detectors are combined into a single input of the timing circuit. After receiving an output indicative of lamp insertion from the lamp insertion detectors, the timing circuit produces a pulse of a predetermined duration to the ballast driver circuit. The ballast driver circuit then applies a high voltage to the corresponding lamp socket for a predetermined time interval to ignite the new lamp.

FIG. 1 illustrates a lighting system 100 that includes a power source 110, a ballast 120, and lamp sockets 161, 161N. Lamp sockets 161, 161N are configured to receive and power lamps 160, 160N. Any number of lamp and/or lamp sockets can be included in lamp system 100. Lamps 160, 160N can be fluorescent lamps or any other type of lamp that utilizes a ballast for ignition and/or control.

Power source 110 supplies power to operate the lighting system 100. The power source can be any type of power source such as a typical 2-phase 240V alternating current (AC) signal. Alternatively, power source 110 can be a 3-phase AC signal, a generator source, a battery, any type of DC power source or other suitable power source.

Ballast 120 can include a ballast driver circuit 130 and a timing circuit 140. In addition, ballast 120 can also include a DC power circuit and rectifier (not shown) to condition power received from the power source 110. The ballast 120 can also include a DC-DC converter if the power source 110 is a DC source or if an alternative voltage level is desired.

When manufactured, sold and/or shipped, embodiments of the lighting system 100 may include only the ballast 120, preferably with one or more of its sub-components, ballast driver circuit 130 timing circuit 140, and lamp insertion detectors 150, 150N, or may include the ballast 120 and the lamp sockets 161, 161N, with or without one or more lamps 160, 160N installed therein. One or more of the sub-components, including, ballast driver circuit 130 timing circuit 140, and lamp insertion detectors 150, 150N, may be formed on a printed circuit board (PCB). This PCB may be manufactured, shipped and/or sold separately or together with the ballast 120 and/or the light sockets 161, 161N. Alternatively, one or all of the sub-components may be separate devices. For example, the lamp insertion detectors 150, 150N may be separate components but coupled to the ballast 120. There may be any number of lamps 160, 160N included in lamp system 100.

Ballast driver circuit 130 can include any elements or devices for driving the lamps such as an inverter, switching elements, a voltage regulator, ballast capacitors and/or a ballast inductor. In addition, the ballast driver circuit 130 can include a warm-up circuit to warm the lamp electrodes prior to ignition to prevent disproportional depletion of the emission coating. Further, ballast driver circuit 130 can include a microprocessor that may include a memory and microprocessor, CPU or the like, such as a general or special purpose microprocessor operable to execute programming instructions or micro-control code associated with light system control. The memory may represent random access memory such as DRAM, or read only memory such as ROM or FLASH. In one embodiment, the processor can execute programming instructions stored in memory. If ballast driver circuit 130 includes a memory, the memory may be a separate component from the processor or may be included onboard within the processor.

The lighting system 100 can also include a plurality of lamp insertion detectors 150, 150N. The lamp insertion detectors 150, 150N can be part of or separate from the ballast 120. Each lamp insertion detector 150, 150N is associated with one of the lamp sockets 160, 160N. For instance, a single lamp insertion detector 150, 150N can be associated with a single lamp socket 160, 160N.

The lamp insertion detectors 150, 150N are configured to monitor lamp insertion into their corresponding lamp sockets 161, 161N. For instance, when a new lamp is inserted into one of the plurality of lamp sockets 161, 161N, the lamp insertion detector 150, 150N can detect a change in state of the lamp socket 160, 160N. An output signal is generated by the lamp insertion detector 150, 150N indicative of the change of state and the signal is transmitted to the timing circuit 140 via one of the output terminals 152, 152N.

According to aspects of the present disclosure, the outputs of the lamp insertion detectors 150, 150N are combined to form an input of the timing circuit 140. For instance, all of the outputs terminals 152, 152N of lamp insertion detectors 150, 150N can be coupled to an input 153 of a timing circuit 140. The input can be a single input terminal of the timing circuit 140.

The timing circuit 140 provides a control signal (or control output) that controls the ballast driver circuit 130 to apply an ignition voltage to start the new lamp. Specifically, the timing circuit 140 generates a triggering pulse that has a predetermined time interval or duration. The triggering pulse is provided to the ballast driver circuit 130. The triggering pulse controls the ballast driver circuit 130 to apply an ignition voltage (i.e. higher voltage) to lamp sockets 161, 161N for the predetermined time interval. After the predetermined time interval, a voltage applied to the lamp sockets 161, 161N is reduced to a normal operating voltage which is different from and can be less than the ignition voltage.

In a particular implementation, timing capacitors C, $C_N$ can be coupled between the lamp insertion detectors 150 and the input 153 of the timing circuit 140 to prevent false output pulses to the timing circuit 140 and to provide timing for the outputs received from the plurality of lamp insertion detector 150, 150N to the timing circuit 140.

Figure 2:
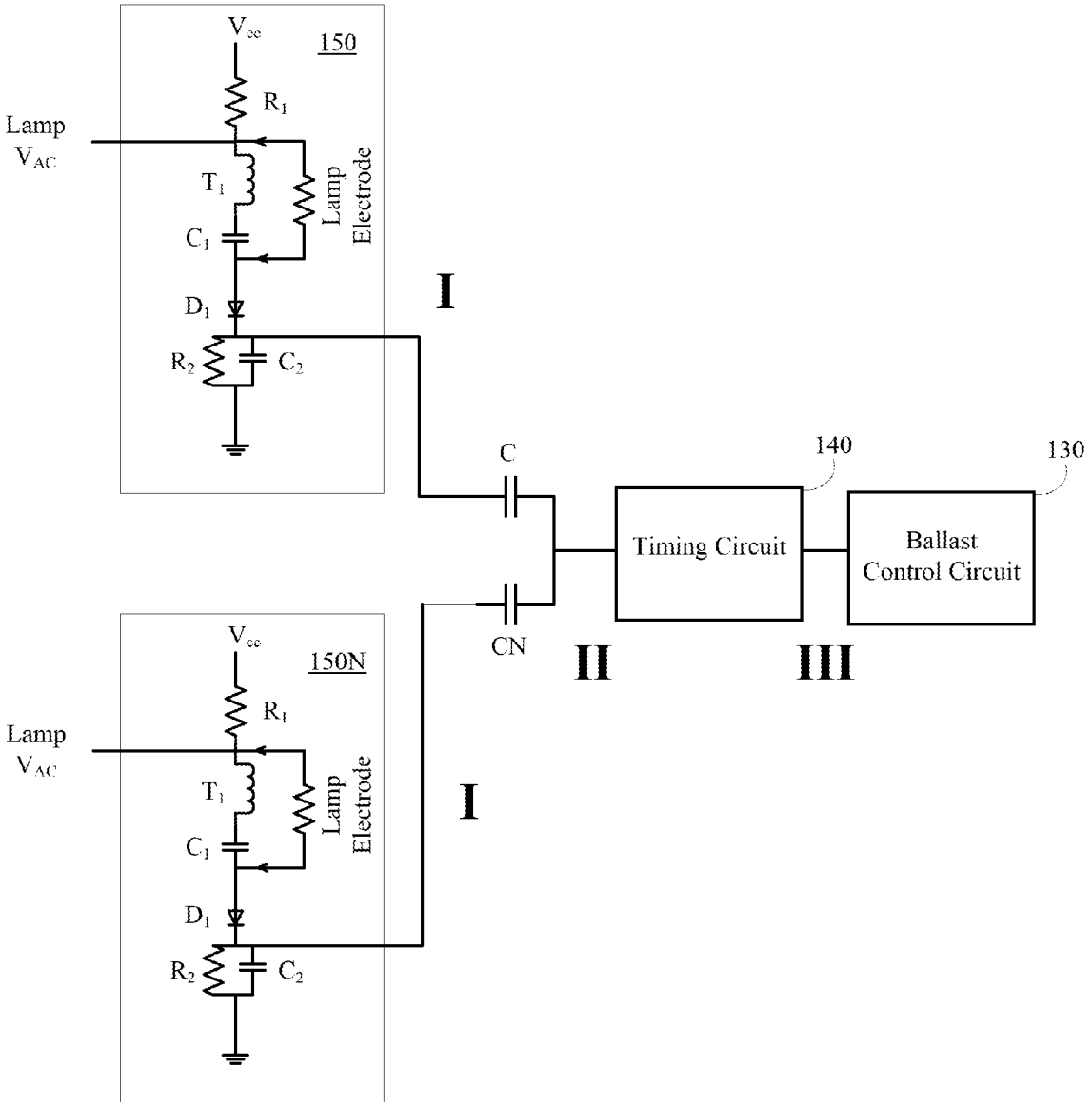
FIG. 2 provides a circuit diagram of an exemplary lighting system according to an exemplary embodiment of the present disclosure.

FIG. 2 illustrates an exemplary configuration of lamp insertion detectors 150, 150N within lighting system 100. Each lamp insertion detector 150, 150N includes a power source Vcc to power the detector, resistive elements $R_1$, $R_2$, a lamp electrode 155, 155N, and a sensing capacitor $C_2$. The lamp electrode 155, 155N represents one end of the lamp coupled in a lamp socket 161, 161N where the lamp socket 161, 161N is coupled to the lamp insertion detector 150, 150N. In addition, a secondary cathode heat transformer $T_1$ and capacitor $C_1$ are included to deliver an ignition voltage to the lamp socket 161, 161N. Lamp $V_{AC}$ is an input signal provided from the ballast driver circuit 130 to provide an AC signal to power a lamp in the lamp socket 161, 161N. When diode $D_1$ is included in the lamp insertion detection circuits 150, 150N, the AC signal supplied by Lamp $V_{AC}$ is rectified into a DC signal. This prevents falsely triggering a pulse to the timing circuit 140 during normal operation of the lamp.

As will be discussed with reference to FIG. 3 below, when no lamp is installed within the lamp socket 161, 161N, $C_1$ charges to maximum capacity and an open circuit is created in the lamp insertion detector 150 preventing current from flowing through diode $D_1$ to resistor $R_2$ and sensing capacitor $C_2$. After a lamp is inserted into the lighting system, current is conducted from Vcc through resistor $R_1$, lamp electrode, and diode $D_1$ to resistor $R_2$ and sensing capacitor $C_2$. As current passes through sensing capacitor $C_2$, a voltage is induced on sensing capacitor $C_2$ and charge begins to be stored.

Figure 3:
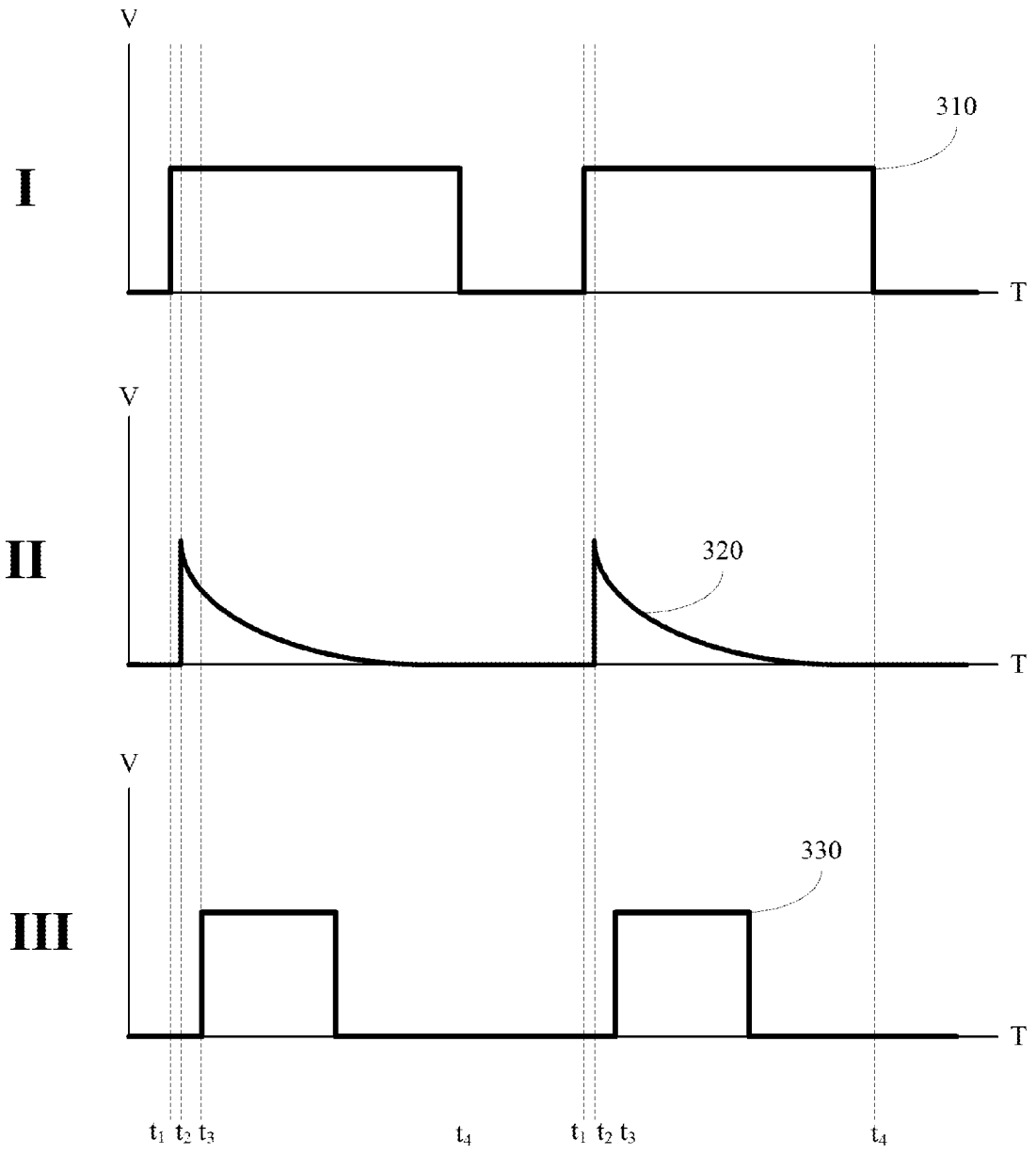
FIG. 3 provides a timing diagram of an exemplary lighting system according to an exemplary embodiment of the present disclosure.

FIG. 3 is a timing diagram of an exemplary configuration of the lighting system shown at three different points I, II, and III in FIG. 2. The time periods illustrated in FIG. 3 are exemplary timing intervals derived from times t1, t2, t3, t4 and may not represent exact timing intervals. Referring to the first graph (I) of FIG. 3, when a lamp 160, 160N is removed from the lighting system prior to t1 (e.g. a lamp is not inserted into a respective lamp socket), a low voltage output, such as 0V, is provided by lamp insertion detector 150, as shown by waveform 310. In particular, when no lamp is installed within the lamp socket 161, 161N, C1 charges to maximum capacity and an open circuit is created in the lamp insertion detector 150 preventing current from flowing through diode D1 to resistor R2 and sensing capacitor C2.

Referring still to graph (I), a new lamp is inserted into a lamp socket 161, 161N of the system at t1 and a high signal is provided by the lamp insertion detectors 150, 150N. In particular, after a lamp is inserted into the lighting system, a circuit is created and current is conducted from Vcc through resistor $R_1$, lamp electrode, and diode $D_1$ to resistor $R_2$ and sensing capacitor $C_2$. As current passes through sensing capacitor $C_2$, a voltage is induced on sensing capacitor $C_2$ and charge begins to be stored.

The output signals 152, 152N of the lamp insertion detectors 150, 150N can be combined into a single output signal provided to the timing circuit 140 as shown in waveform 320 of graph (II). After timing capacitors C, $C_N$ reach a threshold capacity, a signal can be sent from timing circuit 140 to ballast driver circuit 130 as shown in the third graph (III) by waveform 330. This triggering pulse, shown as waveform 330, has a predetermined time interval or pulse width. The triggering pulse can control the ballast driver circuit 130 to provide an ignition voltage to the lamp sockets 161, 161N for a predetermined time period.

Figure 4:
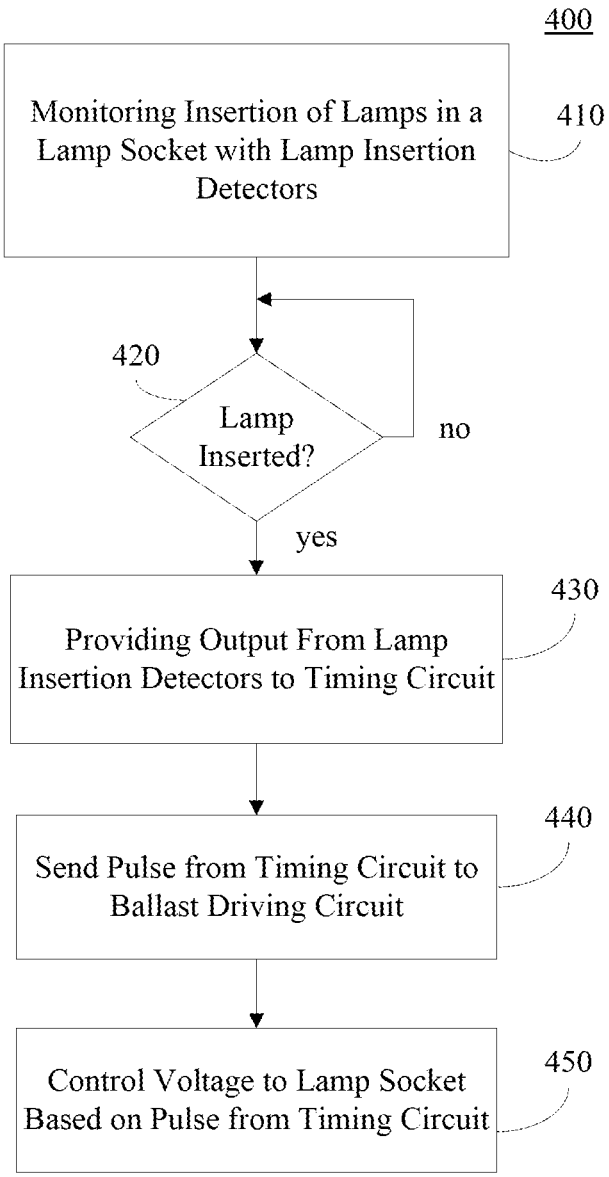
FIG. 4 provides a flow chart of an exemplary method of controlling a lighting system according to an exemplary embodiment of the present disclosure.

FIG. 4 illustrates a flow chart of an exemplary method 400 according to an exemplary embodiment of the present disclosure. The method 400 will be discussed with reference to the exemplary lighting system discussed with reference to FIGS. 1-3. However, the method 400 can be implemented with any suitable lighting control system. In addition, although FIG. 4 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined and/or adapted in various ways.

At (410), the timing circuit system monitors insertion of lamps in the lamp sockets 161, 161N with lamp insertion detectors 150, 150N. The method determines if a lamp has been inserted based on the outputs of the lamp insertion detectors at (420). If so, the outputs of the lamp insertion detectors 150, 150N are combined and provided to the timing circuit 140 at (430). For instance, the outputs of the lamp insertion detectors 150, 150N can be combined and applied to a common input terminal of the timing circuit 140.

At (440), a pulse is sent from the timing circuit 140 to the ballast driver circuit 130 based on the combined outputs of the lamp insertion detectors 150, 150N. As discussed above, the pulse can have a predetermined time interval. At (450), the ballast driver circuit 130 controls the voltage applied to the lamp sockets 161, 161N based on the triggering pulse generated by the timing circuit 140. For instance, the ballast driver circuit 130 can provide an ignition voltage to the lamp sockets 161, 161N for the duration of the time interval and can provide a normal operating voltage to the lamp sockets 161, 161N upon the expiration of the predetermined time interval.

Figure 5:
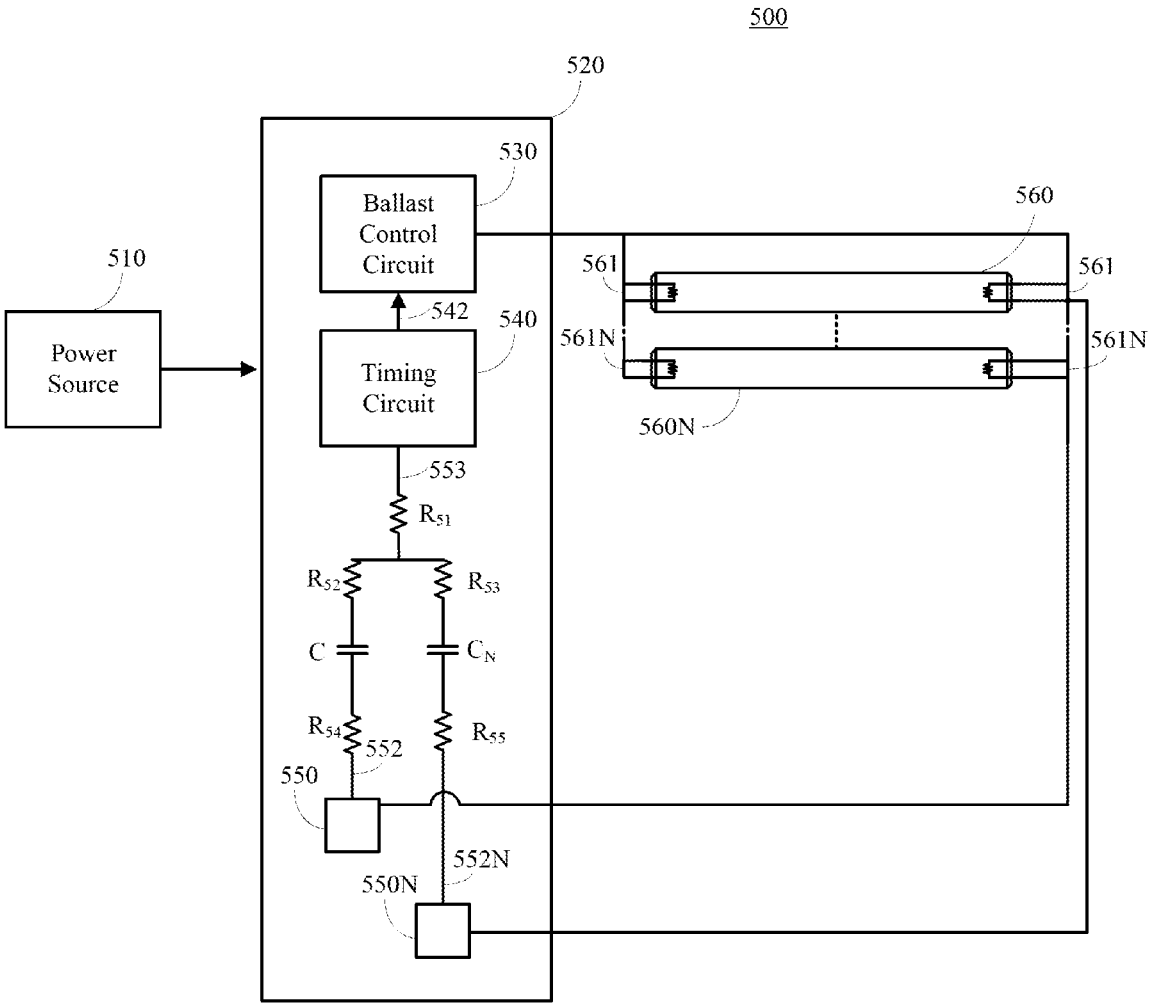
FIG. 5 provides a block diagram of an exemplary lighting system according to another exemplary embodiment of the present disclosure.

FIG. 5 is a block diagram of a lighting system according to another embodiment of the present disclosure. Lighting system 500 can include a power source 510, a ballast 520, and a plurality of lamps 560, 560N corresponding to lamp sockets 561, 561N. The ballast can include a ballast driver circuit 530 and a timing circuit 540. The lighting system 500 can further include lamp insertion detectors 550, 550N configured to monitor lamp insertion into the lamp sockets 561, 561N. The various components of lighting system 500 can be similar to the components of the lighting system 100 discussed and described with reference to FIG. 1.

Referring to FIG. 5, the outputs 552, 552N of the lamp insertion detectors 550, 550N can be combined to form an input of timing circuit 540. Timing circuit 540 is coupled to an input 542 of the ballast driver circuit 530 and provides a control output from the timing circuit 540 to the ballast driver circuit 530 based on the combined outputs 553 received from the lamp insertion detectors 550, 550N.

Timing capacitors C, $C_N$ can be provided between the lamp insertion detectors and the common input 553 of the timing circuit 540. In addition, resistors $R_{51}$, $R_{52}$, $R_{53}$, $R_{54}$ and $R_{55}$ can be coupled between lamp signal detectors 550 and timing capacitors C, $C_N$, and/or coupled between timing capacitors C, $C_N$ and timing circuit 540 to prevent false output triggering pulses to the timing circuit 540 and to adjust signal timing for the output triggering pulse from the plurality of lamp insertion detector 550, 550N to the timing circuit 540. The resistors do not change the fundamental operation of the circuit, but rather affects the timing of the signals. For example, how fast or slow the signals are communicated within the system. In other words, the timing can be modified based on the use of resistors.

Figure 6:
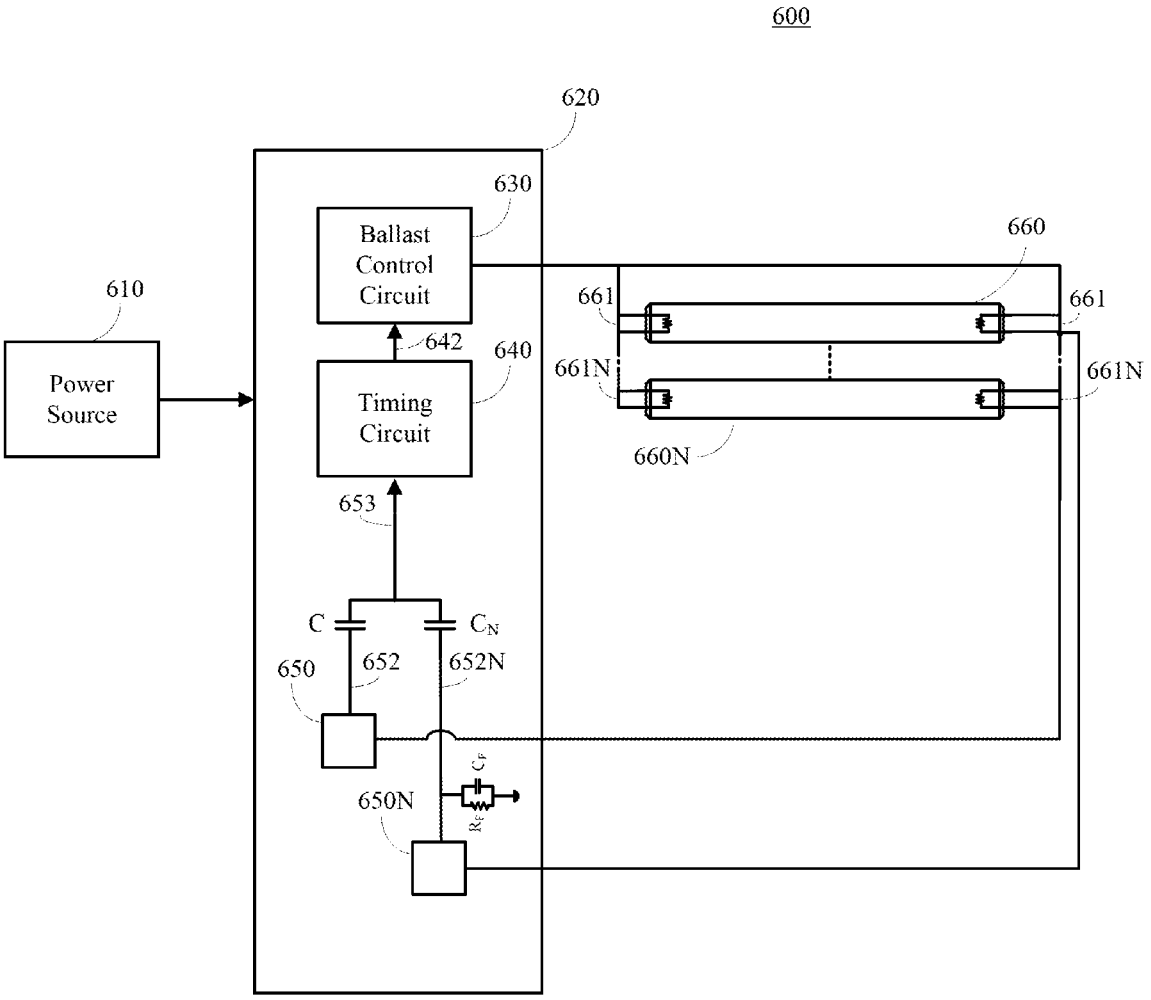
FIG. 6 provides a block diagram of an exemplary lighting system according to another exemplary embodiment of the present disclosure.

FIG. 6 is a block diagram of a lighting system according to another embodiment of the present disclosure. Similar to the lighting system 100 of FIG. 1, the lighting system 600 of FIG. 6 includes a power source 610, a ballast 620, and a plurality of lamps 660, 660N corresponding to lamp sockets 661, 661N. The plurality of lamps sockets 661, 661N can be associated with lamp insertion detectors 650, 650N. The outputs 652, 652N of the lamp insertion detectors 650, 650N can be combined to form an input of a timing circuit 640. Timing circuit 640 is coupled to an input 642 of a ballast driver circuit 630 and provides a control output to the ballast driver circuit 630 based on the combined outputs received from the lamp insertion detectors 650, 650N.

As illustrated, lighting system 600 further includes a filtering element including a filtering capacitor $C_F$ and filtering resistor $R_F$ coupled to at least one output 652N of lamp insertion detectors 650, 650N. While the filtering capacitor $C_F$ and filtering resistor $R_F$ are illustrated as only being associated with output 652N, the filtering capacitor $C_F$ and filtering resistor $R_F$ can be associated with any or all outputs of the lamp insertion detectors 650, 650N. The filtering element can be included as part of the timing circuit or it can be a separate element. While the filtering element, shown in FIG. 6, is coupled to ground, it may alternatively be coupled to a DC voltage. When coupled with a DC voltage, a voltage level shift would occur in the trigger pulse.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A lighting system, comprising:

a ballast having a ballast driver circuit and a timing circuit;

a plurality of lamp sockets coupled to the ballast driver circuit; and a plurality of lamp insertion detectors, each lamp insertion detector associated with at least one of the plurality of lamp sockets, each of the lamp insertion detectors configured to provide an output associated with lamp insertion into one of the plurality of lamp sockets;

wherein the outputs of the plurality of lamp insertion detectors are combined to form an input of the timing circuit, the timing circuit configured to provide a control output to the ballast driver circuit based at least in part on the combined outputs forming the input of the timing circuit;

wherein the lighting system further comprises a plurality of timing capacitors, each timing capacitor coupled in series between the output of one of the plurality of lamp insertion detectors and the combined outputs of the plurality of lamp insertion detectors.

2. A lighting system as in claim 1, wherein the ballast driver circuit is configured to apply an output lamp voltage to each of the plurality of lamp sockets based on the control output received from the timing circuit.

3. A lighting system as in claim 1, wherein the control output provided by the timing circuit to the ballast driver circuit is a pulse having a predetermined time interval.

4. A lighting system as in claim 3, wherein the ballast driver circuit is configured to provide an ignition voltage to each of the plurality of lamp sockets for the predetermined time interval of the pulse.

5. A lighting system as in claim 1, wherein each of the plurality of lamp insertion detectors comprises an output terminal, the output terminal of each of the plurality of lamp insertion detectors being combined at a common input terminal associated with the timing circuit.

6. A lighting system as in claim 1, wherein each lamp insertion detector comprises a sensing capacitor.

7. A lighting system as in claim 1, wherein the lighting system further comprises at least one filtering capacitor coupled between at least one of the plurality of timing capacitors and the input of the timing circuit.

8. A lighting system as in claim 1, wherein the lighting system further includes one or more resistive elements coupled between each of the lamp insertion detectors and the input associated with the timing circuit.

9. A method for controlling a lighting system, the method comprising:

providing an output from each of a plurality of lamp insertion detectors, each lamp insertion detector associated with at least one of a plurality of lamp sockets, each output being associated with lamp insertion into one of the plurality of lamp sockets;

combining the output from each of the plurality of lamp insertion detectors at an input received at a timing circuit;

providing a timing capacitor coupled in series between each output of the lamp insertion detectors and the combined output from each of the plurality of lamp insertion detectors;

providing a control output from the timing circuit to a ballast driver circuit based at least in part on the combined outputs received at the input of the timing circuit.

10. A method as in claim 9, wherein the method further comprises applying an output lamp voltage to each of the plurality of lamp sockets based on the control output received from the timing circuit.

11. A method as in claim 10, wherein the control output comprises a pulse having a predetermined time interval.

12. A method as in claim 11, wherein the method further comprises providing an ignition voltage to a lamp socket for the predetermined time interval of the pulse.

13. A method as in claim 12, wherein the method further comprises providing a reduced voltage to a lamp socket relative to the ignition voltage after the predetermined time interval of the pulse.

14. A method as in claim 9, wherein providing a control output from the timing circuit to a ballast driver circuit based at least in part on the combined outputs received at the input of the timing circuit comprises:

receiving a rising edge of an output from one of the plurality of lamp insertion detectors; and triggering the control output to the ballast driver circuit upon receiving the rising edge of the output.

15. A method as in claim 9, wherein the method further comprises modifying the output of at least one of the plurality of lamp insertion detectors with the timing capacitor.

16. A method as in claim 9, wherein the method further comprises filtering the outputs received from the lamp insertion detectors at the input of the timing circuit with a filtering capacitor.

17. A method as in claim 9, wherein the outputs of the plurality of lamp insertion detectors are combined at a common input terminal of the timing circuit.

18. A method as in claim 9, wherein providing the output from a plurality of lamp insertion detectors comprises providing a low voltage output when a lamp is not inserted into the lamp socket and providing a high voltage output when a lamp is inserted into the lamp socket.

* * * * *